US006637499B2

(12) United States Patent
Hainz, III

(10) Patent No.: US 6,637,499 B2
(45) Date of Patent: Oct. 28, 2003

(54) HEAT SHIELD WITH ADJUSTABLE DISCHARGE OPENING FOR USE IN A CASTING FURNACE

(75) Inventor: Leonard Charles Hainz, III, Albany, OR (US)

(73) Assignee: Retech Systems LLC, Ukiah, CA (US)

( * ) Notice: Subject to any disclaimer, the term of this patent is extended or adjusted under 35 U.S.C. 154(b) by 45 days.

(21) Appl. No.: 10/072,842

(22) Filed: Feb. 6, 2002

(65) Prior Publication Data

US 2003/0145974 A1 Aug. 7, 2003

(51) Int. Cl.[7] ..... B22D 27/04

(52) U.S. Cl. ..... 164/338.1; 164/154.1; 164/339

(58) Field of Search ..... 164/338.1, 154.1, 164/339, 122.1

(56) References Cited

U.S. PATENT DOCUMENTS

| | | | | |
|---|---|---|---|---|
| 3,532,155 A | | 10/1970 | Kane et al. | 164/474 |
| 3,714,977 A | | 2/1973 | Terkelsen | 164/122.1 |
| 4,108,236 A | | 8/1978 | Salkeld | 164/338.1 |
| 4,683,936 A | | 8/1987 | Cybulsky et al. | 164/122.1 |
| 4,712,604 A | | 12/1987 | Sawyer | 164/513 |
| 4,757,856 A | | 7/1988 | George | 164/122.1 |
| 4,763,716 A | | 8/1988 | Graham et al. | 164/122.1 |
| 4,819,709 A | | 4/1989 | Lallement | 164/154.1 |
| 4,969,501 A | | 11/1990 | Brokloff et al. | 164/122.1 |
| 5,429,176 A | | 7/1995 | Atkinson et al. | 164/412 |
| 5,778,961 A | | 7/1998 | Hugo et al. | 164/122.1 |
| 6,209,618 B1 | * | 4/2001 | Chiang | 164/338.1 |
| 6,510,889 B2 | * | 1/2003 | Thompson et al. | 164/122.1 |

* cited by examiner

*Primary Examiner*—Tom Dunn
*Assistant Examiner*—I.-H. Lin
(74) *Attorney, Agent, or Firm*—Townsend and Townsend and Crew

(57) ABSTRACT

A heat shield for a casting furnace (e.g., a directional solidification or single crystal casting furnace) includes a plurality of heat insulating plates (e.g., 6 plates), each with a leading edge. The plurality of heat insulating plates are arranged, for example, in an overlapping layout, such that at least a portion of their leading edges define a discharge opening (e.g., a hexagonal discharge opening in the case of a heat shield with 6 heat insulating plates) circumscribed by the heat insulating plates. The heat insulating plates are moveable in a manner that adjusts (i.e., increases or decreases) the size of the discharge opening. The heat shield also includes a rotatable disk operatively coupled to the heat insulating plates such that when the rotatable disk is rotated in one direction, the heat insulating plates are moved in a manner which decreases the size of the discharge opening. Furthermore, when the rotatable disk is rotated in another direction, the heat insulating plates are moved in a manner which increases the size of the discharge opening.

15 Claims, 3 Drawing Sheets

HEAT SHIELD WITH ADJUSTABLE DISCHARGE OPENING FOR USE IN A CASTING FURNACE

BACKGROUND OF THE INVENTION

1. Field of the Invention

The present invention, in general, relates to furnace apparatus and, in particular, to heat shields for casting furnaces.

2. Description of the Related Art

FIG. 1 is a simplified cross-sectional diagram illustrating a conventional casting furnace 10 (e.g., a directional solidification or single crystal casting furnace). Conventional casting furnace 10 includes a furnace portion 12 disposed above a liquid cooled container 14 (with the locations where a cooling liquid is supplied and a take-out opening provided indicated by labels). Also included in conventional casting furnace 10 is a heat shield 16 located between furnace portion 12 and liquid cooled container 14. Heat shield 16 has a discharge opening 18 therethrough that is aligned with furnace portion 12 and liquid cooled container 14.

During operation of conventional casting furnace 10, a mold 20 holding liquid metal is maintained at an elevated temperature in furnace portion 12. The interior of furnace portion 12 is, therefore, often referred to as the "hot zone" of conventional casting furnace 10. To affect casting of the liquid metal held in mold 20, mold 20 is lowered from furnace portion 12, through discharge opening 18 and into liquid cooled container 14 (the interior of which is referred to as the "cool zone"). Crystal growth in the solidifying liquid metal is controlled by manipulating the temperature of the hot and cold zones and the rate at which mold 20 is lowered from furnace portion 12 into the liquid cooled container 14.

In order to accurately control the crystal growth front in the solidifying liquid metal, a predetermined temperature gradient between the hot zone of the furnace portion and the cool zone of the liquid cooled container is desirable. A drawback of conventional casting furnaces is that the discharge opening in the heat shield allows an undesired transfer of heat between the furnace portion and the liquid cooled container, thus disrupting the temperature gradient. This heat can be transferred, for example, through a gap between the outside of the mold and the heat shield. In other words, a discharge opening that does not closely approximate the contour of the mold can allow undesired heat transfer between the furnace portion and the liquid cooled container. This drawback can be enhanced when the contour (e.g., diameter) of the mold varies across the length (i.e., the vertical axis) of the mold.

To accommodate the use of molds of different contours in a single conventional casting furnace, a given heat shield is customarily removed and replaced with another heat shield that includes a discharge opening of the proper size. Such a heat shield replacement, however, requires that the furnace be shut down and production time lost.

Still needed in the field, therefore, is a heat shield for a casting furnace (e.g., a directional solidification or single crystal casting furnace) that provides for an improved control of the temperature gradient between the hot zone of the furnace portion and the cool zone of the liquid cooled container and, thus, improved control of the crystal growth front. In addition, the heat shield should accommodate molds of different and varying contours.

SUMMARY OF THE INVENTION

The present invention provides a heat shield for a casting furnace (e.g., a directional solidification or single crystal casting furnace) with improved control of a temperature gradient between the hot zone of the furnace portion and the cool zone of the liquid cooled container, thereby improving control of crystal growth. In addition, the heat shield easily accommodates molds of different and varying contours without having to shut down the furnace and lose production time.

A heat shield according to one exemplary embodiment of the present invention is configured for placement between a furnace portion and a liquid cooled container of a casting furnace (e.g., a directional solidification or single crystal casting furnace) and includes a plurality of heat insulating plates, each with a leading edge. These heat insulating plates are arranged such that at least a portion of their leading edges defines a discharge opening circumscribed (i.e., surrounded) by the heat insulating plates. The plurality of heat insulating plates are moveable in a manner that adjusts (i.e., increases or decreases) the size of the discharge opening.

The heat shield also includes a rotatable disk operatively coupled to the heat insulating plates such that when the rotatable disk is rotated in one direction, the heat insulating plates are moved in a manner which decreases the size of the discharge opening. Furthermore, when the rotatable disk is rotated in another direction, the heat insulating plates are moved in a manner which increases the size of the discharge opening.

Since the discharge opening of heat shields according to one exemplary embodiment of the present invention can be easily adjusted (i.e., the size of the discharge opening can be increased or decreased) during operation of the furnace to follow the contour of a mold, a gap between the outside of a mold and the heat shield can be precisely controlled. For example, such a gap can be controlled to a minimum size, thereby eliminating as much heat transfer through the gap as possible and providing a relatively sharp temperature gradient between a hot zone of the furnace portion and a cool zone of the liquid cooled container.

A better understanding of the features and advantages of the present invention will be obtained by reference to the following detailed description that sets forth illustrative embodiments, in which the principles of the invention are utilized, and the accompanying drawings.

DESCRIPTION OF EXEMPLARY EMBODIMENTS OF THE INVENTION

Figure 1:
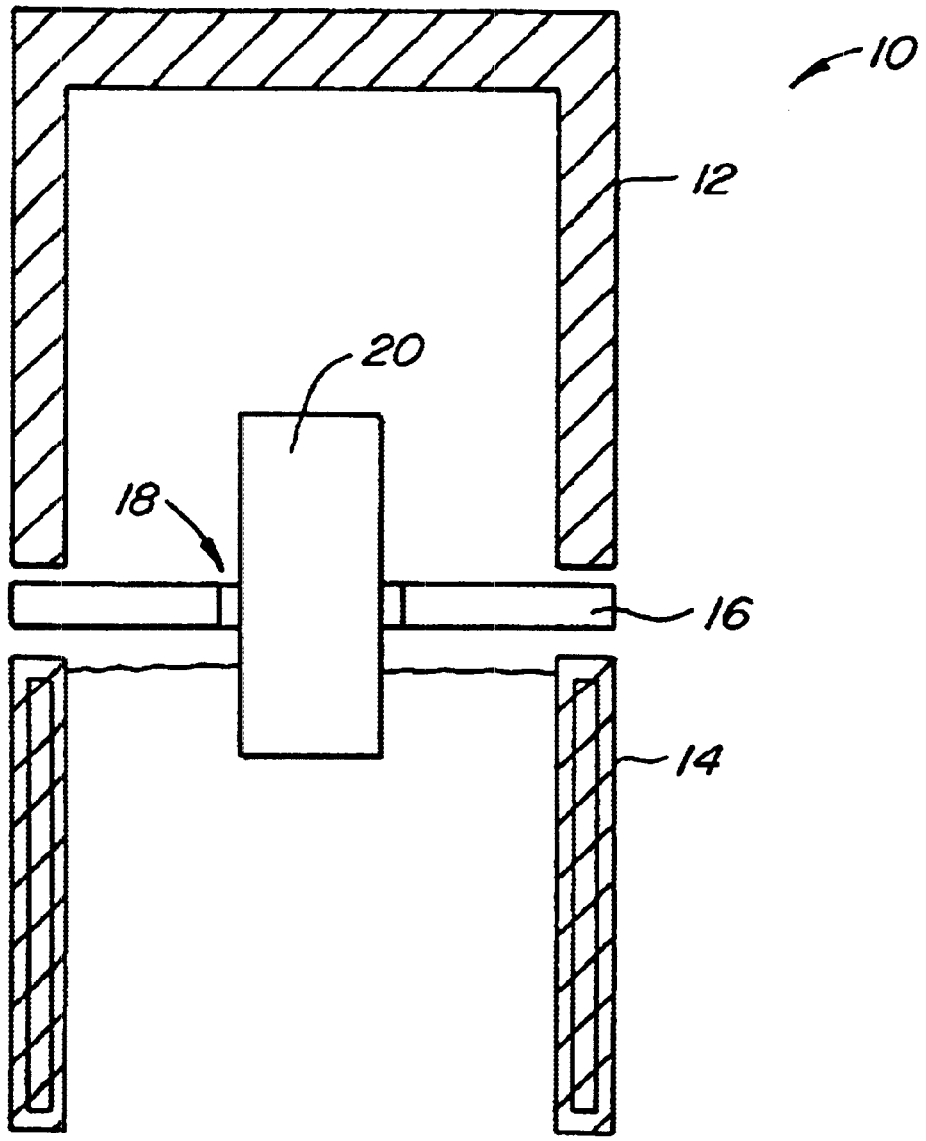
FIG. 1 PRIOR ART
FIG. 1 is a simplified cross-sectional diagram of a conventional casting furnace.
Figure 2:
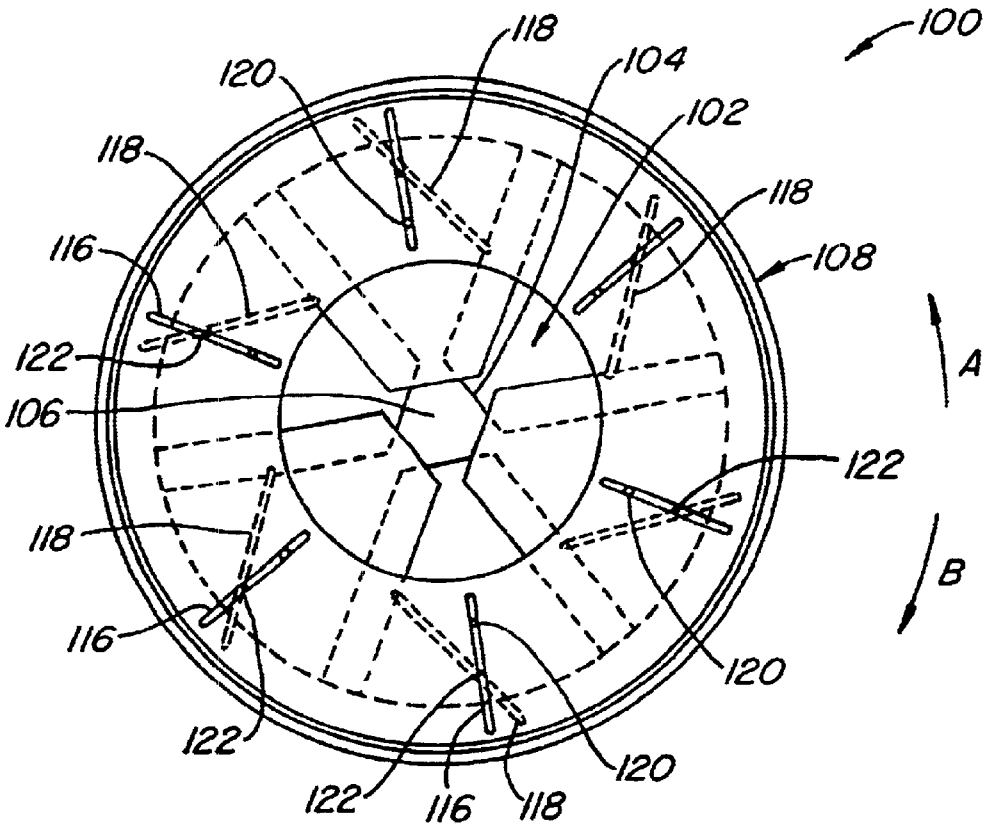
FIG. 2 is a bottom view of a heat shield according to one exemplary embodiment of the present invention, with dashed lines depicting features that would normally be hidden from view.
Figure 3:
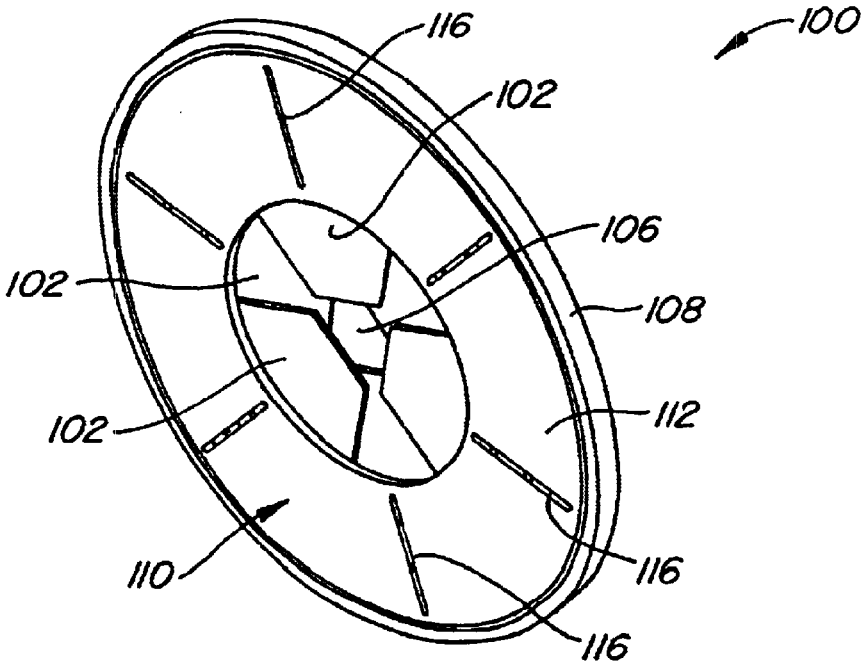
FIG. 3 is a perspective view of the heat shield of FIG. 2.

FIGS. 2 and 3 are bottom and perspective views, respectively, of a heat shield 100 in accordance with one exemplary embodiment of the present invention. In FIG. 2, dashed lines are used to indicate features of the heat shield that would normally be hidden from view in such a bottom view drawing.

Heat shield 100 can be used, for example, in a directional solidification or single crystal casting furnace that includes a furnace portion and a liquid cooled container. In such a circumstance, heat shield 100 can be configured for placement between the furnace portion and the liquid cooled container. Once apprised of the current disclosure, one of ordinary skill in the art will recognize, however, that heat shields according to the present invention can be put to beneficial use with furnaces other than a directional solidification or single crystal casting furnace. In addition, one skilled in the art will recognize that heat shields according to the present invention can be employed between any suitable hot and cold zones in a casting furnace. For example, the heat shields can be used between a hot zone and a conventional water cooled copper cold zone.

Heat shield 100 includes a plurality of heat insulating plates 102, each with a leading edge 104. For illustration and exemplary purposes only, six heat insulating plates are drawn in FIGS. 2 and 3. One skilled in the art will recognize that other quantities of heat insulating plates can be used depending on mold size, shape and configuration and that leading edges 104 need not necessarily be straight. For example, leading edges 104 can be arc-shaped (i.e., curved) or otherwise contoured such that the shape of the discharge opening is complementary to (approximates) a surface of a mold. Heat insulating plates 102 are arranged in two layers, each of which includes three-heat insulating plates. The two layers overlap in a circular fashion such that at least portions of leading edges 104 define a hexagonal discharge opening 106. Hexagonal discharge opening 106 is, therefore, circumscribed by heat insulating plates 102, which are moveable in a manner that adjusts the size of hexagonal discharge opening 106.

Heat insulating plates 102 can be formed of any suitable thermal insulating material known to one skilled in the art including, for example, recrystallized graphite. The thickness of the heat insulating plates can also be selected by one skilled in the art to provide sufficient thermal shielding properties. In addition, the number of heat insulating plates can differ from the six illustrated in FIGS. 2 and 3 with the shape of the discharge opening varying accordingly. For example, in the case of a heat shield with eight heat insulating plates, an octagonal discharge opening can be used. Furthermore, leading edges 104 can be contoured to affect round, elliptical, scalloped or other predetermined discharge opening shapes.

Heat shield 100 also includes a rotatable disk 108 and a fixed disk 110 with heat insulating plates 102 being disposed therebetween. As described in detail below, rotatable disk 108 is operatively coupled to heat insulating plates 102 such that when rotatable disk 108 is rotated in one direction (i.e., the counter-clockwise direction, indicated by arrow A of FIG. 2), the heat insulating plates 102 are moved in such a manner that the size of hexagonal discharge opening 106 is decreased. On the other hand, when rotatable disk 108 is rotated in another direction (i.e., the clockwise direction, indicated by arrow B of FIG. 2), heat insulating plates 102 are moved in such a manner that the size of hexagonal discharge opening 106 is increased. The materials and the dimensions for the fixed disk and the rotatable disk can be selected by one skilled in the art to provide sufficient heat shielding properties.

Fixed disk 110 has an upper surface (not shown in FIGS. 2 and 3), a lower surface 112 and a fixed disk opening 114 extending from the upper surface to lower surface 112. Fixed disk opening 114 is sized and aligned with hexagonal discharge opening 106 such that a mold or other furnace-related article (not illustrated) that passes through hexagonal discharge opening 106 will also pass through fixed disk opening 114. Fixed disk 110 also includes a plurality of radially aligned slots 116. Radially aligned slots 116 are disposed perpendicular to the circumference of fixed disk 110.

Rotatable disk 108 has a plurality of inclined slots 118 (illustrated with dashed lines in FIG. 2) that are disposed at an angle with respect to radially aligned slots 116 and that overlap radially aligned slots 116. Rotatable disk 108 also has a rotatable disk opening (not shown) that is aligned with hexagonal discharge opening 106 such that a mold or other furnace-related article (not illustrated) can pass through the rotatable disk opening prior to passing through hexagonal discharge opening 106. Furthermore, rotatable disk 108 is configured to be rotated without removing heat shield 100 from a casting furnace. For example, rotatable disk 108 can be configured to be rotated while a casting furnace, with which heat shield 100 is being used, remains in operation. This can be accomplished using any suitable disk driving mechanism.

Rotatable disk 108 and fixed disk 110 are operatively coupled to each of heat insulating plates 102 such that when rotatable disk 108 is rotated in one direction (indicated by counterclockwise arrow A in FIG. 2), the heat insulating plates are moved in a manner which decreases the size of hexagonal discharge opening 106. Furthermore, when rotatable disk is rotated in another direction (indicated by clockwise arrow B in FIG. 2), the heat insulating plates are moved in a manner which increases the size of the hexagonal discharge opening 106. The six heat insulating plates, therefore, essentially function as an iris diaphragm to vary the size of a central aperture (i.e., hexagonal discharge opening 106, in the exemplary embodiment shown).

In the embodiment of FIGS. 2 and 3, the ability to increase and decrease the size of hexagonal discharge opening 106 is achieved by (i) operatively coupling fixed disk 110 to each of the heat insulating plates 102 by a plurality of first pins 120, which engage radially aligned slots 116 and by (ii) operatively coupling both the fixed disk 110 and the rotatable disk 108 to each of the heat insulating plates 102 by a plurality of second pins 122, which engage both a radially aligned slot 116 and an inclined slot 118.

The relative inclination of the radially aligned slots 116 and the inclined slots 118, as well as their engagement with first pins 120 and second pins 122, forces the heat insulating plates 102 to move in a linear motion towards (i.e., radially inward along radii of the rotatable disk) and away from (i.e., radially outward along the radii of the rotatable disk) hexagonal discharge opening 106, as rotatable disk 108 is rotated and as first pins 120 and second pins 122 travel along radially aligned slots 116 and inclined slots 118, respectively. Thus, by rotating rotatable disk 108, a relatively larger or smaller hexagonal discharge opening can be created in the exemplary embodiment shown.

In the manner described above, the size of hexagonal discharge opening 106 of heat shield 100 can be easily changed to accommodate molds of different sizes and shapes (i.e., diameters and mold surface contours), thereby minimizing heat transfer between a furnace portion and a liquid cooled container of a casting furnace without having to shut down the furnace and replace the heat shield each time a mold of a different size or shape is used. The size of hexagonal discharge opening 106 can also be adjusted to accommodate a mold with a contour that varies along the length of the mold.

Figure 4:
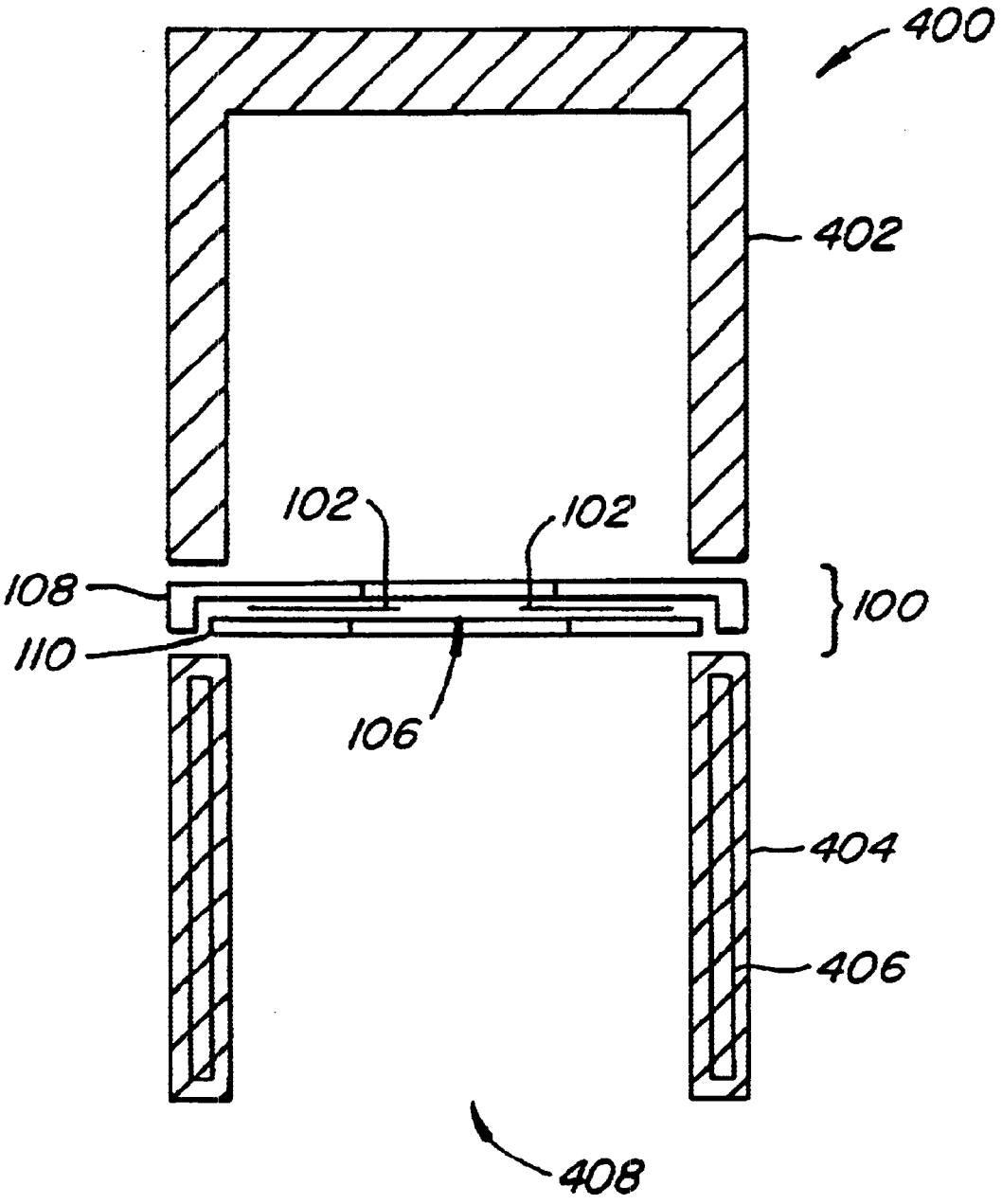
FIG. 4 is a simplified cross-sectional diagram of a heat shield according to one exemplary embodiment of the present invention in use with a casting furnace.

FIG. 4 is a simplified cross-sectional diagram of heat shield 100 in use on a casting furnace 400 (e.g., a directional solidification or single crystal casting furnace). Casting furnace 400 includes a furnace portion 402 and a liquid cooled portion 404. Heat shield 100 is disposed between furnace portion 402 and liquid cooled container 404. Liquid cooled container 404 includes a channel 406 for the provision of a cooling liquid and a take-out opening 408 for removal of a mold. Discharge opening 106 of heat shield 100 is adapted to provide for the passage of a mold (not shown) from the hot zone of a furnace portion to the cool zone of a liquid cooled container. As described with respect to FIGS. 2 and 3, discharge opening 106 is circumscribed by heat insulating plates 102 (shown for simplicity as single lines in FIG. 4). However, discharge openings of heat shields according to the present invention can generally be considered adjustable apertures. Accordingly, a heat shield in accordance with the present invention can be used on any suitable type of furnace to provide a heat shield with adjustable aperture for the passage of a mold or other furnace-related article.

It should be understood that various alternatives to the embodiments of the invention described herein may be employed in practicing the invention. It is intended that the following claims define the scope of the invention and that structures within the scope of these claims and their equivalents be covered thereby.

What is claimed is:

1. A heat shield for use with a casting furnace that includes a furnace portion and a liquid cooled container, the heat shield configured for placement between the furnace portion and the liquid cooled container, the heat shield comprising:

a plurality of heat insulating plates each with a leading edge, the heat insulating plates arranged such that at least a portion of the leading edges defines a discharge opening circumscribed by the heat insulating plates, the heat insulating plates being moveable in a manner that adjusts the size of the discharge opening; and a rotatable disk operatively coupled to the heat insulating plates such that when the rotatable disk is rotated in one direction the heat insulating plates are moved in a manner which decreases the size of the discharge opening and when the rotatable disk is rotated in another direction the heat insulating plates are moved in a manner which increases the size of the discharge opening.

2. The heat shield of claim 1 further including:

a fixed disk with a fixed disk opening extending from its upper surface to its lower surface, the fixed disk opening aligned with the discharge opening; and wherein the heat insulating plates are disposed between the fixed disk and the rotatable disk.

3. The heat shield of claim 2, wherein the fixed disk further includes a plurality of radially aligned slots; and wherein the rotatable disk includes a plurality of inclined slots, the inclined slots disposed at an angle with respect to the radially aligned slots and overlapping the radial slots; and wherein the heat insulating plates are operatively coupled to the fixed disk and the rotatable disk via pins, which engage at least one of the radially aligned slots and the inclined slots.

4. The heat shield of claim 1, wherein the rotatable disk is configured to be rotated while the furnace is in operation.

5. The heat shield of claim 1, wherein the plurality of heat insulating plates are moveable along radii of the rotatable disk.

6. The heat shield of claim 1, wherein the plurality of heat insulating plates includes 6 heat insulating plates and the discharge opening is hexagonal in shape.

7. The heat shield of claim 1, wherein the plurality of heat insulating plates are formed of recrystallized graphite.

8. The heat shield of claim 1, wherein the plurality of heat insulating plates are arranged in an overlapping manner.

9. The heat shield of claim 8, wherein the plurality of heat insulating plates are arranged in two overlapping layers.

10. The heat shield of claim 1 configured for use in a directional solidification casting furnace.

11. The heat shield of claim 1 configured for use in a single crystal casting furnace.

12. The heat shield of claim 1, wherein the leading edges are straight.

13. The heat shield of claim 1, wherein the leading edges are not straight.

14. The heat shield of claim 1, wherein the plurality of heat insulating shapes define a discharge opening with a discharge opening shape complementary to a surface of a mold.

15. A heat shield for use in a casting furnace, the heat shield comprising:

a plurality of heat insulating plates each with a leading edge, the heat insulating plates arranged such that at least a portion of the leading edges defines an aperture circumscribed by the heat insulating plates, the heat insulating plates being moveable in a manner that adjusts the size of the aperture; and a rotatable disk operatively coupled to the heat insulating plates such that when the rotatable disk is rotated in one direction, the heat insulating plates are moved in a manner which decreases the size of the aperture and when the rotatable disk is rotated in another direction, the heat insulating plates are moved in a manner which increases the size of the aperture.

* * * * *